US005462282A

United States Patent [19]

Romano

[11] Patent Number: 5,462,282

[45] Date of Patent: Oct. 31, 1995

[54] CREATIVE GAME

[76] Inventor: Pame A. M. L. C. Romano, P.O. Box 15953, Honolulu, Hi. 96830

[21] Appl. No.: 210,436

[22] Filed: Mar. 21, 1994

[51] Int. Cl.[6] ..... A63F 3/00

[52] U.S. Cl. ..... 273/240; 273/249; 273/290; 273/138 R; 273/291; 273/440; 273/424

[58] Field of Search ..... 273/240, 293, 273/294, 148 R, 290, 291, 249

[56] References Cited

U.S. PATENT DOCUMENTS

| | | | |
|---|---|---|---|
| 7,756 | 6/1877 | Richardson | 237/294 |
| 738,701 | 9/1903 | Sauer | 273/291 |
| 957,105 | 5/1910 | Russell | 273/240 |
| 1,391,333 | 9/1921 | McManus | 273/249 |
| 1,519,133 | 12/1924 | Hall | 273/249 |
| 2,320,184 | 5/1943 | Kramer | 273/284 |
| 3,033,572 | 5/1962 | Thibault | 273/243 |
| 4,013,294 | 3/1977 | Smeda et al. | 273/249 |
| 5,048,841 | 9/1991 | Manney et al. | 273/246 |
| 5,340,113 | 8/1994 | Respicio | 273/249 |

FOREIGN PATENT DOCUMENTS

| | | | |
|---|---|---|---|
| 604791 | 9/1978 | Switzerland | 273/294 |

OTHER PUBLICATIONS

"Math Caps" by S.E.I., Inc.

"Pai Gow", WIN Magazine, Apr. 1992, pp. 39, 40 and 70.

*Primary Examiner*—Benjamin H. Layno

*Attorney, Agent, or Firm*—Michael I. Kroll

[57] ABSTRACT

A creative game is provided which consists of a plurality of gaming chips and identifiable indicia printed on one side of each gaming chip. When identifiable indicia is marked by a highlight color marker to indicated different value combinations, the gaming chips will become similar to playing cards to be utilized in playing games.

4 Claims, 2 Drawing Sheets

CREATIVE GAME

BACKGROUND OF THE INVENTION

1. Field of the Invention

The instant invention relates generally to table top games and more specifically it relates to a creative game utilizing gaming chips.

2. Description of the Prior Art

Numerous table top games have been provided in prior art that are adapted to be competitive and are played upon game boards. While these units may be suitable for the particular purpose to which they address, they would not be as suitable for the purposes of the present invention as heretofore described.

SUMMARY OF THE INVENTION

A primary object of the present invention is to provide a creative game that will overcome the shortcomings of the prior art devices.

Another object is to provide a creative game that contains a plurality of gaming chips, a pair of dice and a game board, which can be utilized in several different ways for playing different types of board games.

An additional object is to provide a creative game in which the gaming chips containing printed indicia thereon can be marked in different value combinations, so that the gaming chips are now similar to playing cards which can be used in playing card games.

A further object is to provide a creative game that is simple and easy to use.

A still further object is to provide a creative game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
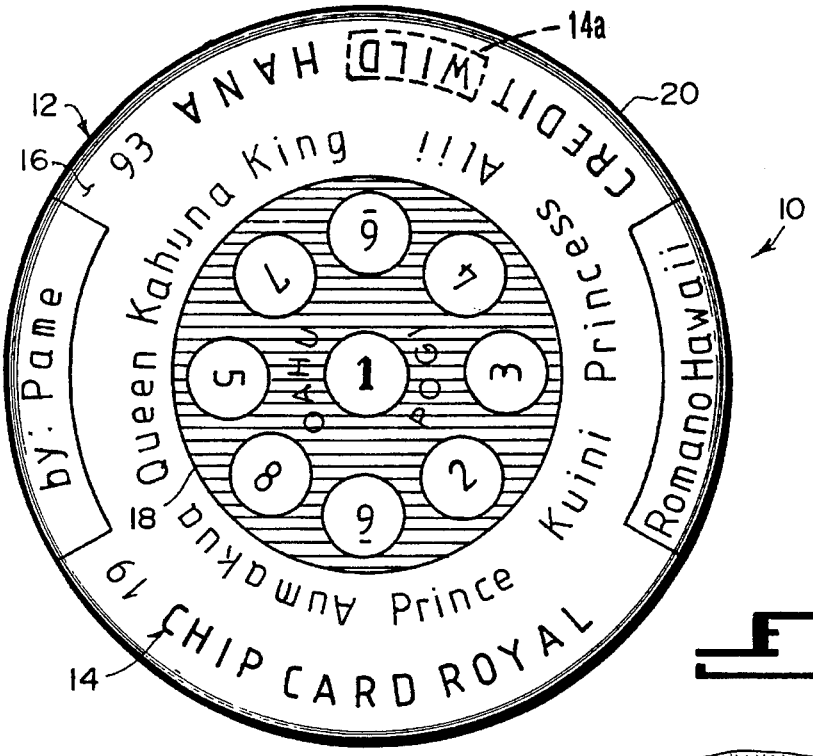
FIG. 1 is a top plan view of one gaming chip showing the indicia thereon.

Turning now descriptively to the drawings, in which similar reference characters denote similar elements throughout the several views, FIGS. 1 through 8 illustrate a creative game 10 which consists of a plurality of gaming chips 12 and identifiable indicia 14 printed on one side 16 of each gaming chip 12. When the identifiable indicia 14 is marked by a highlight color marker to indicate different value combinations, for example, the area 14*a* shown in phantom colored in red by a marker, the gaming chips 12 will become similar to playing cards to be utilized in playing games.

As best seen in FIG. 1, the identifiable indicia 14 on the gaming chip 12 includes a central circle 18 having a circled number "1" in the center with circled numbers "2", "3", "4", "5", "6", "7", "8" and "9" surrounding counterclockwise the number "1". The numbers "6" and "9" are underlined, so that they can be read in any direction. The words "OAHU" and "POGI" are left and right of the number "1".

Names of rulers of rank alternating in English and Hawaiian are counterclockwise about the central circle 18 being the words in English—"King", "Queen", "Prince" and "Princess" and the words in Hawaiian—"Kahuna", "Aumakua", "Kuini" and "Alii".

Designations are counterclockwise about the perimeter 20 being the words "CHIP", "CARD", "ROYAL", "CREDIT", "WILD" and "HANA" (a Hawaiian word for work), so as to indicate different points and dollars. The identifiable indicia 14 can be printed in a different color on the gaming chips 12 to indicate different values.

Figure 2:
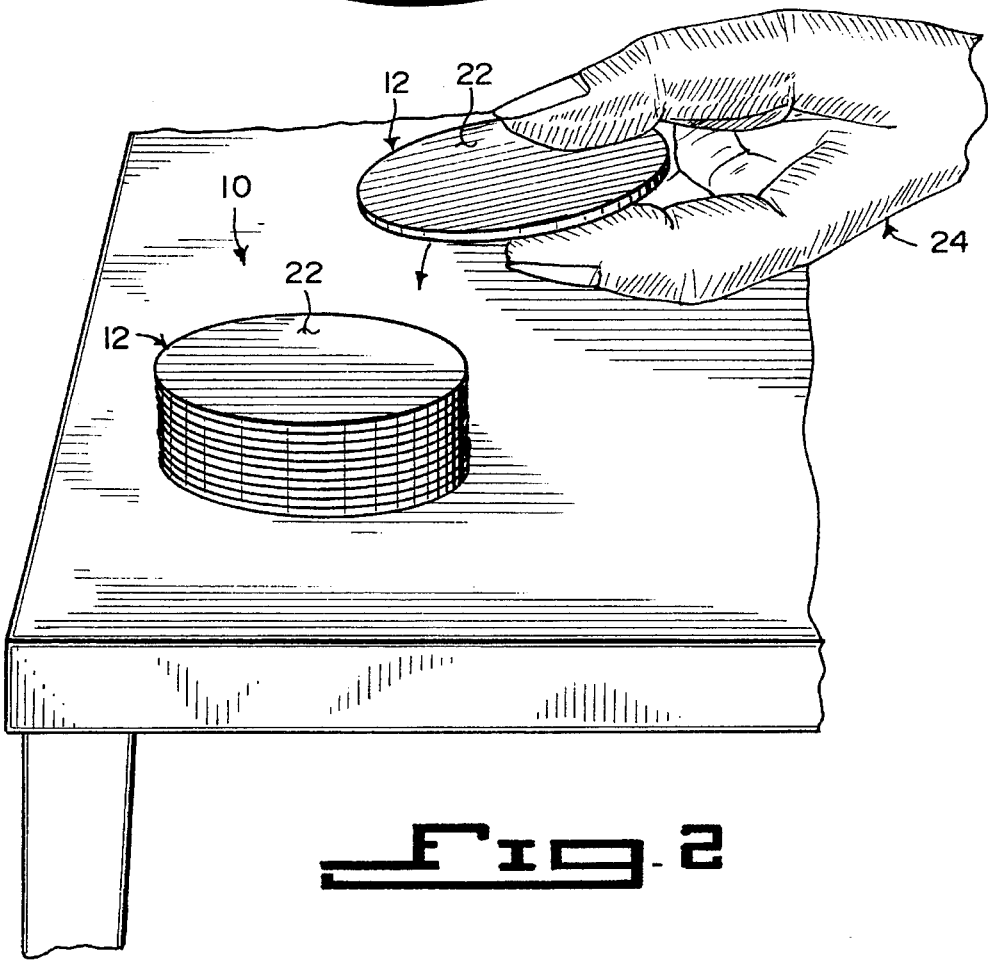
FIG. 2 is a perspective view showing a plurality of the gaming chips being used in playing a game of POG.

As shown in FIG. 2, the gaming chips 12 can be utilized in playing a Hawaiian game called "POG" in which some of the gaming chips 12 are stacked face down with the blank side 22 up. When the stack of the gaming chips 12 are struck by one gaming chip 12 thrown by a player 24, that player 24 will only collect the gaming chips 12 that turn face up after bouncing off of the stack of gaming chips 12.

Figure 3:
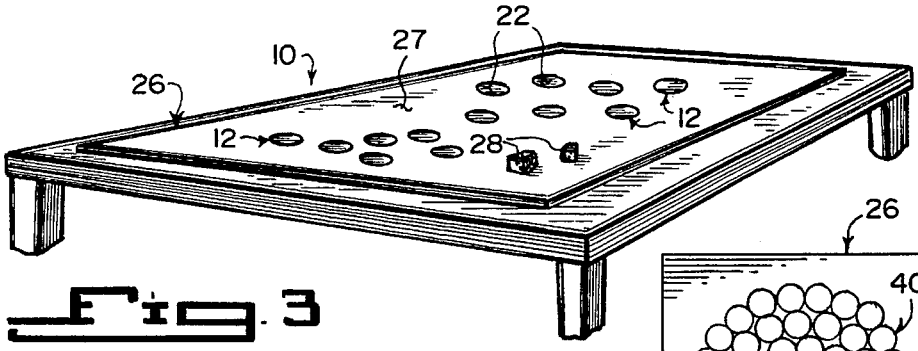
FIG. 3 is a perspective view showing a first type of game on a game board with various components for playing the game thereon.

FIG. 3 shows a game board 26 having a blank surface 27, in which a plurality of the gaming chips 12 can be randomly placed face down upon the blank surface 27 of the game board 26. A predetermined amount of the gaming chips 12 can be picked by each player and turned over face up to count the points indicated to determine the winner of the game. A pair of dice 28 are used in conjunction with the game board 26. Each player can determine by the roll of the pair of dice 28, how many turns they may take in picking up the gaming chips 12.

Figure 4:
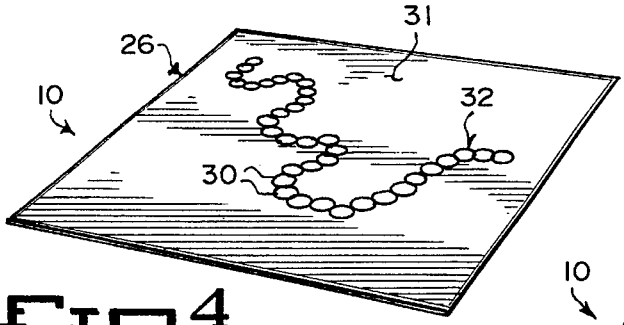
FIG. 4 is a perspective view of a second type of game on a reverse side of the game board.

In FIG. 4, the game board 26 includes a plurality of circular spots 30 printed on an opposite second surface 31 in an end to end chain link random course 32. Each player in turn can utilize one gaming chip 12 to travel from a predetermined start position to a predetermined finish position on the circular spots 30 along the chain link random course 32 by the roll of the pair of dice 28. The winner is the first player to complete the chain link random course 32.

Figure 5:
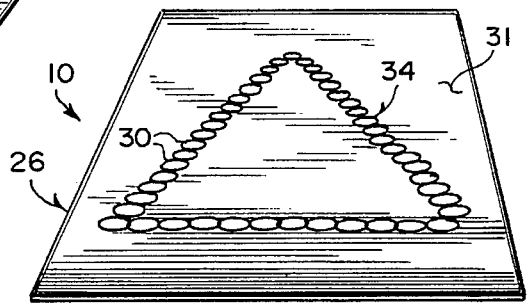
FIG. 5 is a perspective view of a third type of game on the reverse side of the game board.

The game board 12 in FIG. 5, shows a plurality of circular spots 30 printed on the opposite second surface 31 in an end to end chain link triangular course 34. Each player in turn can utilize one gaming chip 12 to travel from a predetermined start position to a predetermined finish position on the circular spots 30 along the chain link triangular course 34, by the roll of the pair of dice 28. The winner is the first player to complete the chain link triangular course 34.

Figure 6:
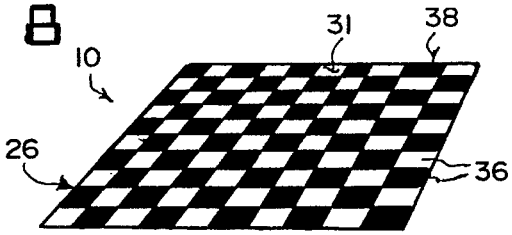
FIG. 6 is a perspective view of a fourth type of game on the reverse side of the game board.

The game board 26, as shown in FIG. 6, contains a plurality of squares 36 of two alternating colors on the opposite second surface 31 for dividing the opposite second surface 31 of the game board 26 into a checkerboard pattern 38. The players can utilize the gaming chips 12 thereon face down in a start position similar to checkers. Each player turns the gaming chips 12 over in their turn and moves the gaming chips 12 in the squares 36 on the opposite second surface 31 of the game board 26 according to the value indicated on the gaming chips 12, in a similar fashion to the game of the checkers.

Figure 7:
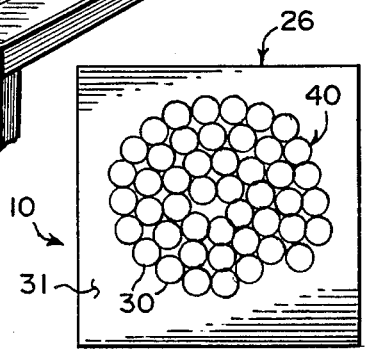
FIG. 7 is a top plan view of a fifth type of game on the reverse side of the game board.

The game board 26, as shown in FIG. 7, includes a plurality of circular spots 30 printed on an opposite second surface 31 in an end to end chain link spiral course 40. Each player in turn can utilize one gaming chip 12 to travel from a predetermined start position to a predetermined finish position on the circular spots 30 along the chain link spiral course 40 by the roll of the pair of dice 28. The winner is the first player to complete the chain link spiral course 40.

Figure 8:
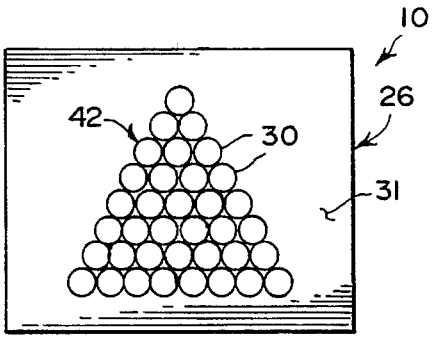
FIG. 8 is a top plan view of a sixth type of game on the reverse side of the game board.

The game board 26 in FIG. 8, contains a plurality of circular spots 30 printed on an opposite second surface 31 in an end to end chain link pyramid course 42. Each player in turn can utilize one gaming chip 12 to travel from a predetermined start position to a predetermined finish position on the circular spots 30 along the chain link pyramid course 42 by the roll of the pair of dice 28. The winner is the first player to complete the chain link spiral course 42.

RULES OF THE GAME

1. It will be at the option of a Game Master (Dealer), to change the value of the "PRINCE" or "PRINCESS", and the "ALII" or "KUNINI", with a roll of the dice 28 by the Game Master, or by the decision of the Game Master.

2. Gaming chips 12 can come in different main colors, as in playing cards— green and black and other different colors, red, blue and orange.

3. Using a highlight (color) marker—mark off any number combination of numbers, or numbers and rank, or "CHIP" with value; use numbers, also "WILD", "CARD" or "CREDIT", with or without value. This is to make your deck of playing gaming chips 12 or the "CHIP" values as points or other meanings of value. Or mark the back 22 of the gaming chips 12 with a color or letter or number.

4. Another option is to use a black marker and block out, mark out what is not needed.

8. Game; using stacking tray holding up to seven gaming chips 12 used as a holder for different games, or using double stacking trays for other games. Use of different colored stones as moving players.

9. Game; in points as value chips, or credit; black may be higher and green as lower values, as in tens or hundreds, or lower or higher values, other values for different colors, red and blue.

10. Game; spread out gaming chips 12 on a table or box face down, or in a bag, mix them up, take turns picking up and selecting five to seven or more depending on choice of game, or degree of challenge, decided by the Game Master.

11. Separate box for picking gaming chips 12 for points and credits or distribute even amounts to each person at the start of the game, depending on the number of players or game pieces available, or size of the game, or choice of the Game Master.

12. Board option (A)—is made and designed by the Game Master. One example of a game board 26 is a display of thirty gaming chips 12, more or less, laid end to end in chain links of any turn or spiral length, then from drawing of marked gaming chips 12 of "CREDIT", "WILD" or other marked or unmarked gaming chips 12, or gaming chips 12 can be face down for blanks. The Game Master makes the board or path and set the start and finish of the path.

13. Board option (B)—position gaming chips 12 in a pyramid fashion, to as many as the Game Master decides, or at the throw of the dice 28, from five to twelve across on the bottom row. The Game Master decides to start either at the top or at either end of the bottom.

14. By drawing of one gaming chip 12, colored either as black or green, the player can advance two extra spaces for a black gaming chip 12, after the throw and move on the total of the dice 28. The green gaming chips 12 goes back two spaces after the throw and moves on the total of dice 28. For bonuses to draw, exchange gaming chips 12, to change status of the player, only when the player lands on a "WILD" card or "AUMAKUA" gaming chip 12.

15. At the Game Master's choice, at the throw of double on the throw of the pair of dice 28, the player has the option to take two extra spaces forward or backward.

16. At the Game Master's choice for any double on the throw of the dice 28, the player has to draw a new gaming chip 12 face down, "ROYAL" or "HANA"; "HANA" gains one space, "ROYAL" two spaces.

17. Gaming chips 12 can also substitute for checkers or chess pieces, or any other type of game board 26, as in backgammon, etc.

18. Use different colored stones as moving players instead of gaming chips 12.

19. On any game board 26 using the gaming chips 12 as playing positions, the chips 12 can be used either face up or face down in any random order. This is so a face up chip 12 can be designated a value of loss or gain depending on the Game Masters decisions. This is also to give the game board 26 a challenge and interest.

LIST OF REFERENCE NUMBERS

10 creative game
12 gaming chip
14 identifiable indicia
16 one side of 12
18 central circle on 16
20 perimeter of 12
22 blank side of 12
24 player
26 game board
27 blank surface of 26
28 pair of dice
30 circular spot
31 opposite second surface of 26
32 chain link random course on 31
34 chain link triangular course on 31
36 square on 31
38 checkerboard pattern on 31
40 chain link spiral course on 31
42 chain link pyramid course on 31

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A creative game which comprises:

a) a plurality of gaming chips;

b) identifiable indicia printed on one side of each said gaming chip, so that when said identifiable indicia is marked by a highlight color marker to indicate different value combinations, said gaming chips will become similar to playing cards to be utilized in playing games;

c) said identifiable indicia of different color to indicate different values on each said gaming chip including a central circle having a circle number "1" in the center with circled numbers "2", "3", "4", "5", "6", "7", "8", and "9" surrounding counterclockwise the number "1", whereby the number "6" and "9" are underlined so that they can be read in any direction, names of rulers of rank alternating in English and Hawaiian counterclockwise about said central circle being the words in English—"King", "Queen", "Prince", and "Princess", and the words in Hawaiian—"Kahuna", "Aumakue", "Kuini", and "Alinii", designations counterclockwise about the perimeter being the words "CHIP", "CARD", "ROYAL", "CREDIT", "WILD", and "HANA" (a Hawaiian word for work), so as to indicate different points;

d) a game board having a blank surface in which a plurality of said gaming chips can be randomly placed down upon said blank surface of said game board, whereby a predetermined amount of said gaming chips can be picked by each player and turned over face up to count the points indicated to determine the winner of the game;

e) a pair of dice used in conjunction with said game board, so that each player can determine by the roll of said pair of dice, how many times they may take in picking up said gaming chips; and f) said game board including a plurality of circular spots printed on an opposite second surface in an end to end chain link random course, so that each player in turn can utilize one of said gaming chips to travel from a predetermined start position to a predetermined finish position on said circular spots along said chain link random course by the roll of said pair of dice, in which the winner is the first player to complete said chain link random course.

2. The creative game as recited in claim 1 in which said random course is in the shape of a triangle.

3. The creative game as recited in claim 1 in which said random course is in the shape of a spiral.

4. The creative game as recited in claim 1 in which said random course is in the shape of a pyramid.

* * * * *